US005198627A

United States Patent [19]

Diaz et al.

[11] Patent Number: 5,198,627

[45] Date of Patent: Mar. 30, 1993

[54] ELECTRONIC MODULE SWITCH AND POWER AND INTERLOCK SYSTEM

[75] Inventors: Randall J. Diaz, Gilroy; Melvin J. Phillips, Cupertino, both of Calif.

[73] Assignee: Tandem Computers Incorporated, Cupertino, Calif.

[21] Appl. No.: 743,003

[22] Filed: Aug. 9, 1991

[51] Int. Cl.[5] ..... H01H 9/20

[52] U.S. Cl. ..... 200/50 B

[58] Field of Search ..... 200/50 R, 50 A, 50 B, 200/43.01–43.22; 361/380, 391

[56] References Cited

U.S. PATENT DOCUMENTS

| | | | |
|---|---|---|---|
| 3,932,716 | 1/1976 | Mottel et al. | 200/50 A |
| 4,345,122 | 8/1982 | Janniello | 200/50 B |
| 4,777,332 | 10/1988 | Diaz | 200/50 A |
| 4,885,436 | 12/1989 | Pham et al. | 200/50 A |
| 4,931,907 | 6/1990 | Robinson et al. | 361/391 |
| 4,985,695 | 1/1991 | Wilkinson et al. | 200/43.02 X |

*Primary Examiner*—J. R. Scott
*Attorney, Agent, or Firm*—Townsend and Townsend

[57] ABSTRACT

An electronic module configured to removably receive a power cord is provided with an interlock mechanism that prevents the power cord from being attached or removed while the module is in a power-on or current-drawing condition. The electronic module includes an on/off switch that, when in its on state, places the electronic module in a power-on condition. A guard mechanism is mounted to the electronic module, proximate the power switch, and is movable from a first position that captures and holds the power cord in connected condition with the electronic module, or prevents connection with the electronic module, to a second position permitting removal or connection of the power cord. Movement of the guard mechanism from the first position to the second position is permitted only if the power switch is in an off state.

21 Claims, 3 Drawing Sheets

ELECTRONIC MODULE SWITCH AND POWER AND INTERLOCK SYSTEM

BACKGROUND OF THE INVENTION

The present invention is directed generally to an interlock system for preventing connection or disconnection of an electrical line or cord to an electronic module while the module is in a power-on, current-drawing state.

Applying power to, or removing power from, an electronic module while in the power-on or current-drawing state is a problem long recognized in the art (see, e.g., U.S. Pat. No. 3,919,507 to Middleton, Jr., dated Nov. 11, 1975). Typically, the problem is encountered when the module is inserted in or removed from a larger system. Removable electronic modules, when inserted or removed, can, if in the power-on state, can create power transients that may damage electronic circuitry contained in the module, or create problems in the system into/from which the module is being inserted/removed.

Such problems have been encountered, and addressed in connection with removable electronic modules having blind matable connections. Solutions include latch handles or insertion/extraction mechanisms mounted in cooperative relation to a power on/off switch, forming an interlock mechanism that is operable to permit insertion or removal of the module only if the module is in a power-off, non-current-drawing state. Examples of such mechanisms include U.S. Pat. Nos. 4,777,332, 4,885,436, and 4,931,907.

These interlock mechanisms are, however, directed to insuring that the electronic module is in a power-off state when inserting or removing the module from a larger system. They do not provide any protection for electronic modules of the type that receive a removable electrical and/or power cord connection.

Accordingly, there is a need for an interlock system to prevent connection or removal of a power cord to an electronic module while the module is in a power on state.

SUMMARY OF THE INVENTION

The present invention is directed to an interlock mechanism that can be inexpensively made and easily used to prevent an electrical line or cord (e.g., a power connection) from being connected to, or removed from, an electronic module while the module is in a current-drawing (i.e., power-on) state.

Broadly, the invention includes a guard unit mounted to the module proximate the connection point for the electrical cord. The guard unit is movable between first and second positions, and, while in the first position, operates to capture and hold the electrical cord connected to the electronic module; conversely, while in the first position, and if the electrical cord is not connected, the guard unit prevents connection of the electrical cord. When in its second position, the electrical cord can be freely removed or connected to the electronic module. A two-position power switch for the module is mounted in relation with the guard unit so that movement of the guard unit from the first position to the second position only if the two-position power switch is in a position that places the electronic module in a power-off state.

In a preferred embodiment of the invention, the guard unit is mounted to the electronic module proximate a connection point for removable power cord. Adjacent the connection point is a power on/off switch used to selectively place the electronic module in an on (current-drawing) or off (non-current drawing) state. The power switch is of a rocker switch type, configured to be engaged by a ramped surface of the guard unit so that movement of the guard unit from the first to the second position in order to remove a connected power cord, or to expose the connection point to connection of the power cord, causes the power switch to be placed in condition. Thereby, a user is automatically precluded from connecting or disconnecting the power cord while the module is in its on state.

In an alternate embodiment of the invention the guard unit is configured to include a cut-out that coacts with a strain relief formed on the electrical cord, proximate the connector end. The cut-out in the guard unit operates to capture and hold the electrical cord to provide addition strain relief.

In yet another embodiment of the invention the guard unit is provided with means for locking electronic module in place in a cabinet.

There are a number of advantages that flow from the present invention. Foremost of which is the fact that the interlock system of the present invention prevents connection of an electrical or power cord to an electronic module unless that electronic module is placed in a non-current-drawing condition by a manual on/off switch. This, in turn, will prevent the possible creation of damaging power transients.

An additional advantage resides in the incorporation of the ramped surface in the guard unit that operatively engages the power switch to automatically caused the module to be placed in an off state in order to connect or dis-connect an electrical cord.

A further advantage of the invention is that the guard unit, by being in one or the other of its positions, serves as a visual indicator of the current-drawing state of the module.

Yet another of the advantage flows from an embodiment of the invention in which the electronic module can be locked in place in a cabinet through use of the guard unit.

These and other advantages will become apparent to those skilled in the art upon a reading of the following detailed description of the invention, which should be taken in conjunction with the accompanying drawings.

DETAILED DESCRIPTION OF THE INVENTION

Figure 1:
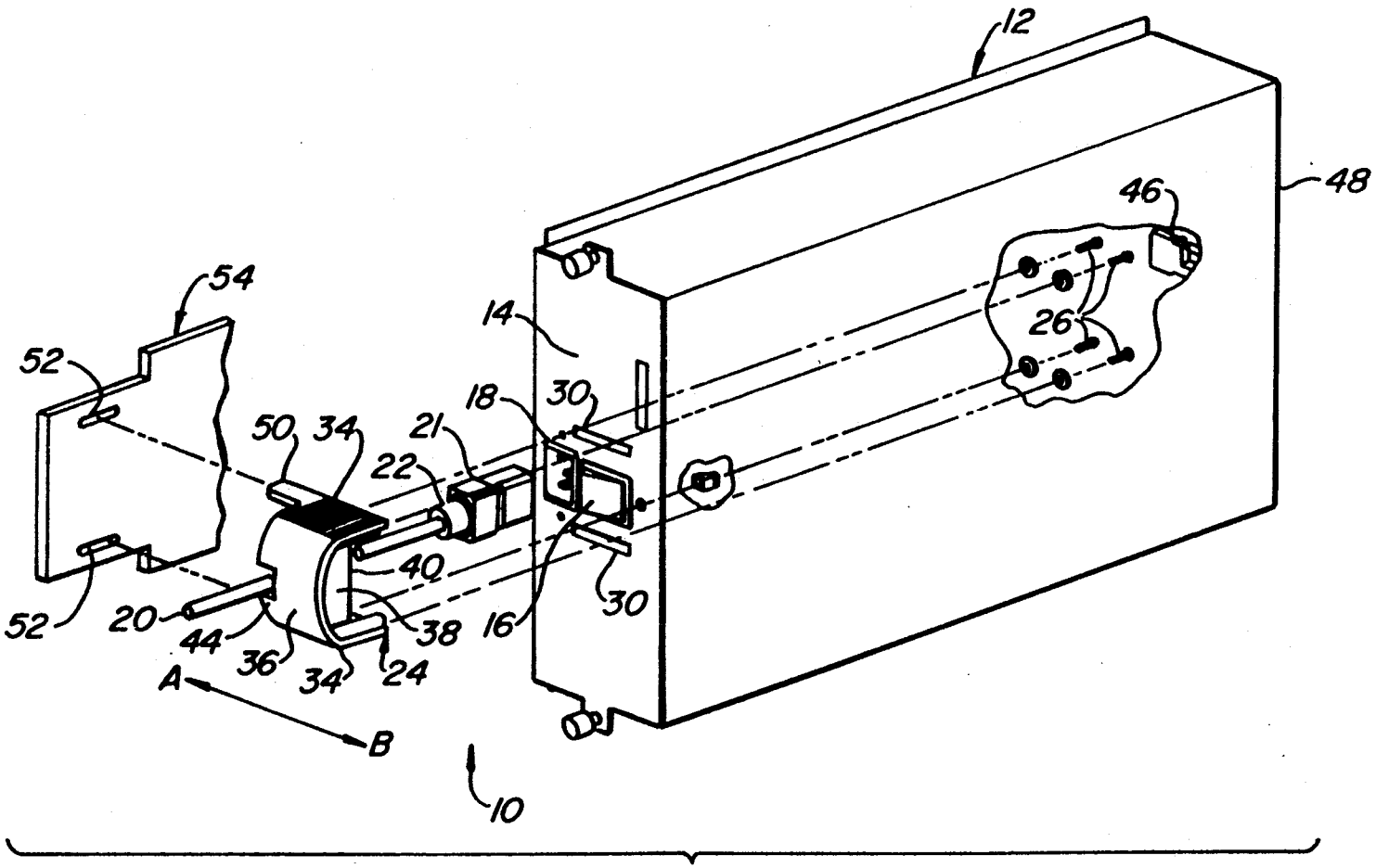
FIG. 1 is an exploded, perspective view of an electronic module incorporating the interlock system of the present invention.

Referring now to the figures, and in particular FIG. 1, the interlock system of the present invention is identified generally by the reference numeral 10, and is incorporated to be used with an electronic module 12 having a front face 14 upon which is mounted a rocker-type power switch 16 and a power cord connector 18 for receiving the business end 21 of a power cord 20. Power cord 20 is of conventional design, having a post-strain relief configuration 22 formed proximate the end 21.

Also mounted to the front wall 14 of the electronic module 12 is a guard unit 24. Threaded screws 26 protrude through elongate slots 30, formed in the front wall 14, to be received by internally threaded apertures (not shown) formed in the guard unit 24. The slots 30 permit the guard unit 24 to be moved to and from a position that obscures access to the power cord connector 18 in directions indicated by the double-headed arrow A-B.

The guard unit 24 is formed with a pair of sidewalls 34 joined by an arcuate top portion 36. An internal structural wall 38 is formed to extend between the sidewalls 34 to provide structural integrity to the guard unit 24. The lower edge 40 of the internal structural wall 38 is provided a ramped or inclined construction 42 (see FIG. 2A and 2B), the function of which will be described below. The top portion 36 of guard unit 24 is provided with a cut-out 44 through which the electrical cord 20, but not the end 21, may pass. The cut-out 44 can operate to provide some strain relief to the electrical cord 20. Although not specifically shown, the cut-out 44 can be structured to snugly capture and hold any strain relief formed on the electrical cord 20.

As indicated above, the elongate slots 30 permit the guard unit 24 to slide or move along the directions indicated by the double-headed arrow A-B (FIG. 1) between two positions: a first position that places the guard unit 24 spaced from the power switch 16 and proximate the connecter 18; and a second position that places the guard unit 24 in engagement with the power switch 16, and removed from a position that obscures access to the connecter 18. When in its first position, the guard unit 24 prevents removal of the power cord 20, as better illustrated in FIGS. 2A and 2B, by positioning the upper portion 36 in the path of removal; alternatively, if the power cord 20 is not connected, the guard unit 24, while in its first position, will prevent connection of power cord 20 with the connector 18.

Figure 2A:
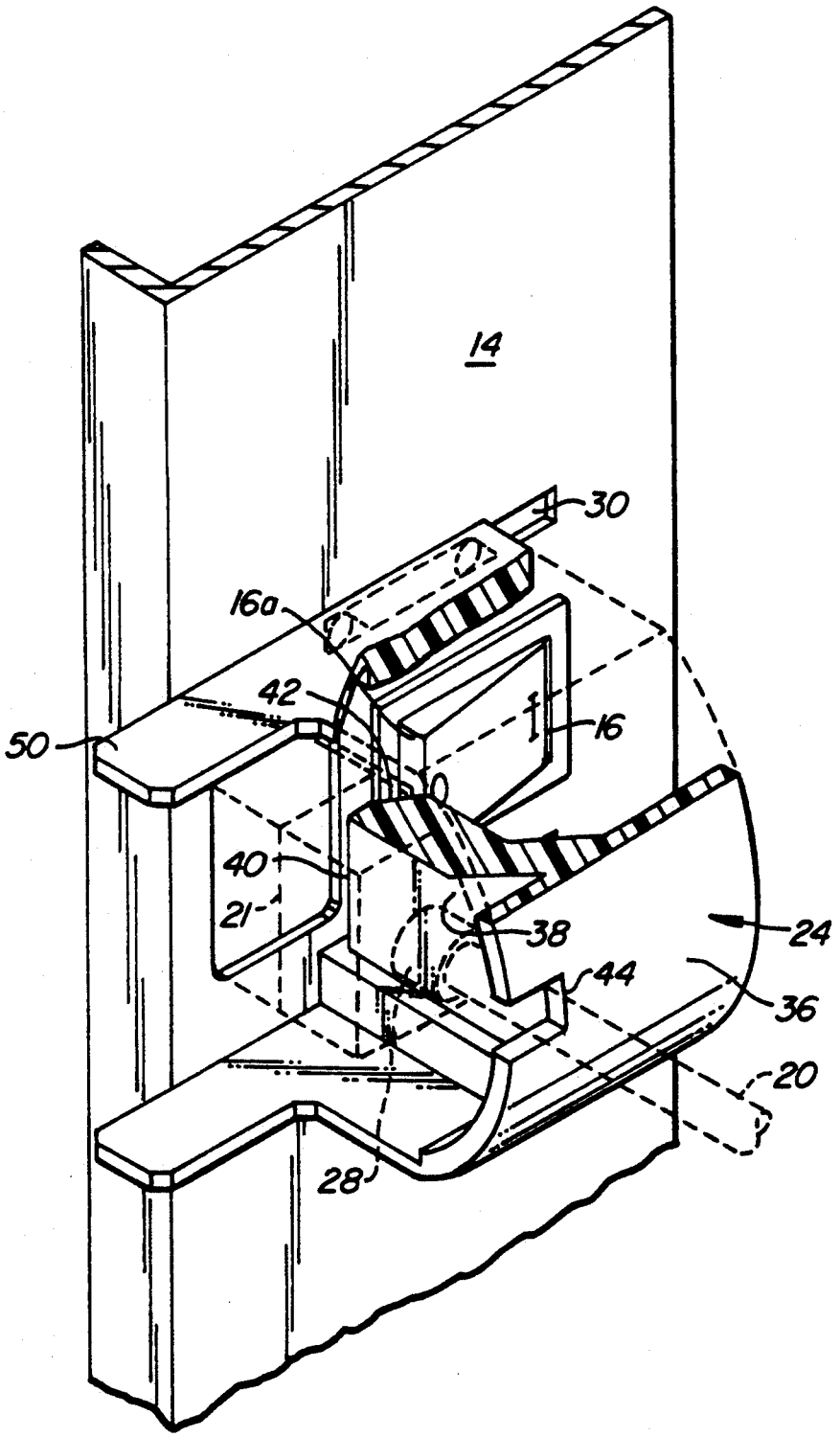
FIGS. 2A and 2B are perspective views, in partial section, of the guard unit and power switch that form, together with the removable electrical cord, the interlock system of the invention of FIG. 1, illustrating the operative cooperative relationship between the two.
Figure 2B:
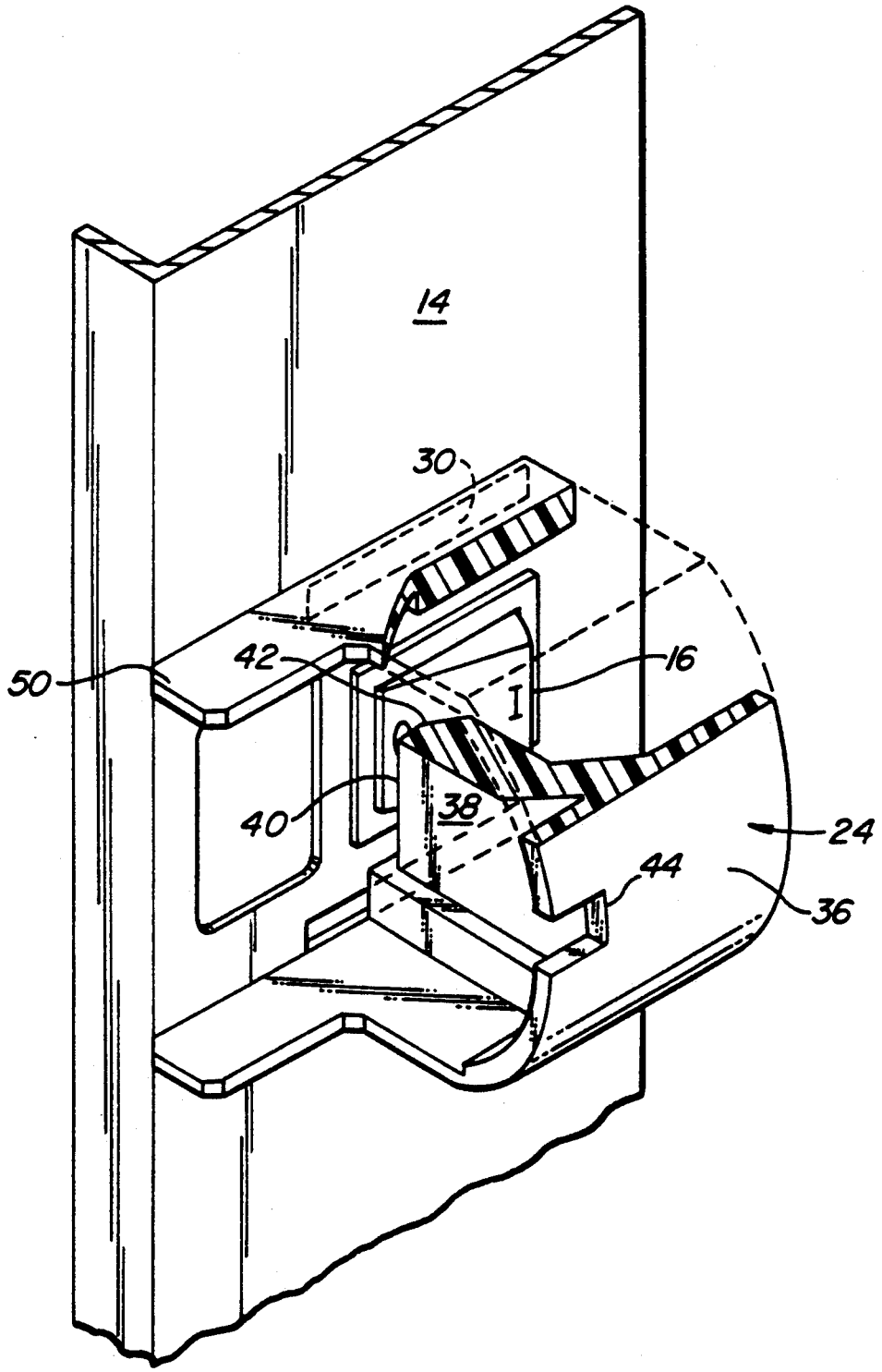

The power switch 16 is, as indicated above, a rocker-type switch, preferably finger-depressible, capable of being placed in one of two switch positions: a power-on position, in which the electronic module 12 is in a power-on, current-drawing condition, and a power-off position, in which the electronic module 12 is in a power-off, non-current-drawing condition. FIGS. 2A and 2B better illustrate these two positions of the power switch 16. Note, as best seen in FIG. 2A, that when the power switch 16 is in its power-on position, travel of the guard unit 24 from its first position (proximate the power cord connector 18, obscuring access thereto - FIG. 2A) toward the second position (FIG. 2B) is impeded by the power switch 16. However, as discussed more below, placing the guard unit 24 in its second position actuates the power switch 16, placing it in its power-off position (if it was in the power-on position before movement of the guard unit 24).

Movement of the guard unit 24 from its first position to its second position requires that the power switch 16 be placed in its power-off position, as illustrated in FIG. 2B. Thus, in order for guard unit 24 to be moved to permit the power cord 20 to be connected or disconnected, the power switch 16 must be in its off state, placing the electronic module 12 in a non-current-conducting condition.

In the preferred embodiment of the invention, movement of the guard unit 24 from the first to the second state alone will cause the power switch 16 to switch from an on to an off state. This is effected by engagement of the ramped construction 42 of the edge 40, formed on the structural member 38. Moving the ramped construction 42 into engagement with a rounded surface 16*a* of the power switch 16 causes the ramped portion 40 to force the power switch 16 to rock about its pivot point and ultimately to its power-off position.

It should be noted at this point that the guard unit 24 is capable of providing a tentative visual indication of the current drawing state of the module 12. Thus, when the guard unit is in its first position a user is thereby notified that the module may be in a power-on state. Conversely, if the guard unit 24 is in its second position (FIG. 2B), the user knows the module 12 is in a power-off state. Note also that the guard unit 24, if constructed properly, can function as a pull or a handle for the module 12.

The electronic module 12 preferably is constructed to be inserted in a cabinet (not shown) or other assembly, using a blind-matable connection such as that of U.S. Pat. No. 4,682,833. Thus, the electronic module 12 includes a connector port 46 mounted at the back 48 of the electronic module 12. The cabinet (not shown) would include a module-receiving bay or receptacle having a connector port (not shown) matable with the connector port 46 when the electronic module 12 is inserted in the cabinet.

In an alternate embodiment of the invention, the guard unit 24 is provided with a pair of parallel, spaced finger members 50 that are adapted to be received by apertures 52 formed in an extension plate 54. The extension plate 54 would preferably be a part of a sidewall (not shown) of the cabinet (not shown) configured to receive electronic module 12. When the guard unit 24 is moved to its first position, to capture and hold an electronic cord 20 connected to the electronic module 12, the finger members 50 are received by the apertures 52, locking the electronic module 12 in the cabinet. In order to remove the electronic module 12, the guard unit must be moved from its first position to its second position, removing the finger members 50 from the slot 52, and unlocking the electronic module 12 from the cabinet (not shown), at the same time placing the power switch 16 in its off state.

In the preferred embodiment of the invention, the guard unit 24 is formed from an injection molded plastic.

While the complete description of the invention has been made, it will be obvious to those skilled in the art that various alterations and modifications can be made. For example, the preferred embodiment of the invention provides cooperative surfaces (i.e., ramped portion 40 of the guard unit 24 and rounded surface 16*a* of the power switch 16) in order to effect placement of the power switch in its off state merely by movement of the guard unit 24. However, if desired, the ramp surface 40 can be deleted and the structural member 38 formed to require manual operation of the power switch 16 to place it in its off state before the guard unit 24 can be moved to its second position.

What is claimed is:

1. Interlock apparatus for preventing connection of an electrical cord to a receptacle of an electronic module when in a power-on condition, the interlock apparatus comprising:

switch means mounted to the module, proximate the receptacle, and operable in a first state to place the electronic module in a power-on condition and exposing a switch surface of the switch means, and in a second state to place the electronic module in a power-off condition removing the switch surface from exposure;

guard means mounted to the electronic module for movement between a first position for preventing connection of the power cord to the receptacle, and a second position allowing connection of the power cord, the guard means including means for impeding movement of the guard means from the first position to the second position when the guard means is the first state and the switch surface is exposed.

2. The interlock of claim 1, wherein the guard means and the switch means are cooperatively configured to cause the switch means to be moved from the first position, when in the first position, to the second position when the guard mean sis moved to the second position for allowing the electrical power cord to be connected to the electronic module.

3. The interlock of claim 2, wherein the switch means is a finger-operable rocker switch.

4. The interlock apparatus of claim 3, wherein the guard means includes ramp means situated to engage the switch surface to cause the switch means to be placed in the second state when the guard means is moved to the second position.

5. The interlock apparatus of claim 1, wherein the guard means is configured to prevent disconnection of the electrical power cord from the electronic module when in the first position until the switch means is moved to the second position.

6. The interlock apparatus of claim 1, wherein the electronic module is a power supply.

7. The interlock apparatus of claim 6, wherein the power supply is of the type operable to receive a source of alternating current supplied by the electrical cord for producing a direct current.

8. The interlock apparatus of claim 1, wherein the electrical cord is connected to the receptacle, the guard means being operable in the first position to inhibit removal of the electrical cord from the receptacle.

9. An interlock system for preventing removable connection of an electrical cord for supplying electrical power to an electronic module while the electronic module is in a power-on condition, the interlock system comprising:

switch means mounted to the electronic module and operable to be placed in a first state that causes electrical power to be supplied by the power cord to the electronic module or a second position that inhibits electrical power to be supplied to the electronic module by the electrical cord;

a guard element mounted to the electronic module and movable between a first position that impedes connection of the electrical cord to the electronic module and a second position that permits the electrical cord to be connected to the electronic module;

the switch means including means that operates to impeded movement of the guard element from the first position when the switch means is in the first state.

10. The interlock system of claim 9, wherein the electronic module is a power supply.

11. The interlock system of claim 9, wherein the switch means is a finger-depressible rocker switch.

12. The interlock system of claim 9, wherein the electrical cord is connected to the module to supply power thereto, the guard element being operable to inhibit removal of the electrical cord when in the first position.

13. The interlock system of claim 9, wherein the electronic module is housed in a cabinet that includes wall structure proximate the electronic module and having at least one aperture formed therein, and wherein the guard element includes a first extension formed and configured to be received by the aperture when the guard element is placed in the first position to prevent removal of the electronic module from the cabinet until the guard element is moved to the second position.

14. The interlock system of claim 12, there being another aperture formed in the wall structure and spaced from the one aperture, and wherein the guard element includes at least a second extension, located generally parallel to the first extension, and formed and configured to be received by the another aperture.

15. The interlock system of claim 9, wherein the guard element is configured to provide strain relief to the electrical cord.

16. The interlock system of claim 9, wherein the guard element is shaped and configured to function as a handle for the electronic module.

17. An interlock system for preventing removal of an electrical cord that supplies electrical power to an electronic module while the electronic module is in a power-on condition, the electronic module being of the type having an receptacle that removably receives the electrical cord for connection thereat to the module, the interlock system comprising:

guard means mounted to the electronic module and movable between a first position and a second position, the guard means including means for preventing removal of the electrical cord from the receptacle when the guard means is in the first position and allowing removal of the electrical cord when in the second position; and switch means mounted to the electronic module and operable to be placed in a first state that causes electrical power to be supplied by the power cord to the electronic module or a second position that inhibits electrical power to be supplied to the electronic module by the electrical cord, the switch means including means for impeding movement of the guard means from the first position when the switch means is in the first state.

18. The interlock system of claim 17, wherein the guard means includes means for preventing connection of the electrical cord to the receptacle of the module when the guard means is in the first position.

19. The interlock system of claim 18, wherein the preventing means includes a top portion that obstructs access to the receptacle when the guard means is in the first position.

20. The interlock system of claim 17, wherein the switch means includes a switch surface that is exposed to impede movement of the guard means from the first position when the switch means is in the first state.

21. The interlock system of claim 20, wherein the switch surface is moved to a location that permits the guard means to be moved from the first position to the second position when the switch means is in the second state.

* * * * *